United States Patent [19]

Svensson

[11] 3,987,593

[45] Oct. 26, 1976

[54] POSTS

[76] Inventor: Lars Svensson, Vikingavagen 112, 183 43 Taby, Sweden

[22] Filed: Apr. 14, 1975

[21] Appl. No.: 567,991

Related U.S. Application Data

[63] Continuation of Ser. No. 389,319, Aug. 17, 1973, abandoned.

[30] Foreign Application Priority Data

Aug. 25, 1972 Sweden ..... 11016/72

[52] U.S. Cl. ..... 52/98; 52/727; 52/730; 404/10

[51] Int. Cl.[2] ..... E04C 3/04; E04C 3/29

[58] Field of Search ..... 52/98, 28, 721–723, 52/730, 731, 727; 404/10

[56] References Cited

UNITED STATES PATENTS

| | | | |
|---|---|---|---|
| 455,084 | 6/1891 | Wolfertz | 52/653 |
| 1,804,320 | 5/1931 | Cross | 52/730 |
| 1,858,512 | 5/1932 | Langenberg | 52/725 |
| 3,004,640 | 10/1961 | Macomber | 52/732 |
| 3,013,584 | 12/1961 | Reed | 52/727 |
| 3,196,990 | 7/1965 | Handley | 52/731 |
| 3,735,547 | 5/1973 | Moyer | 52/731 |

FOREIGN PATENTS OR APPLICATIONS

| | | | |
|---|---|---|---|
| 272,618 | 10/1968 | Austria | 52/731 |
| 433,585 | 9/1926 | Germany | 52/722 |
| 1,484,216 | 1/1969 | Germany | 52/28 |
| 366,908 | 1/1923 | Germany | 52/732 |
| 416,868 | 12/1946 | Italy | 52/730 |
| 451,064 | 8/1949 | Italy | 52/722 |

*Primary Examiner*—Price C. Faw, Jr.
*Assistant Examiner*—Henry Raduazo
*Attorney, Agent, or Firm*—Bucknam & Archer

[57] ABSTRACT

A post for use in, for example, street-lighting, comprising a number of substantially longitudinal stiffening rods of a suitable material, such as steel, fastened to an interior or exterior shell of a suitable material, such as steel. The novel matter of the invention is that the connections which give the different parts of the pole their static cooperation, are broken at a certain measure of transverse stress caused by, for example, collision with a motor vehicle, so that the pole's strength and resistance to deformation are greatly reduced.

4 Claims, 6 Drawing Figures

FIG. 4
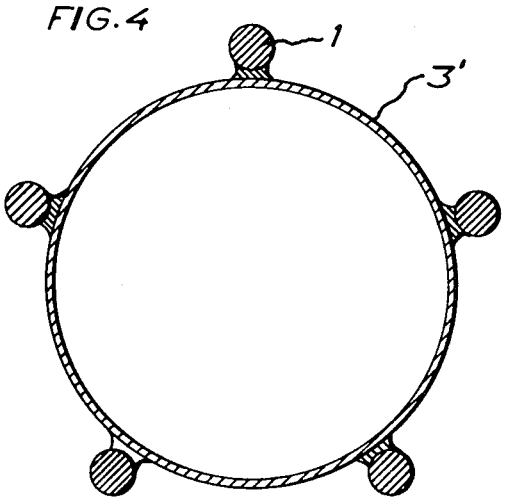
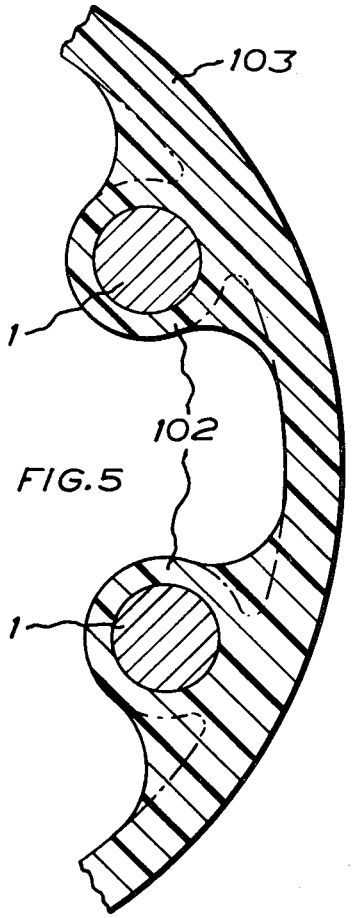
FIG. 5
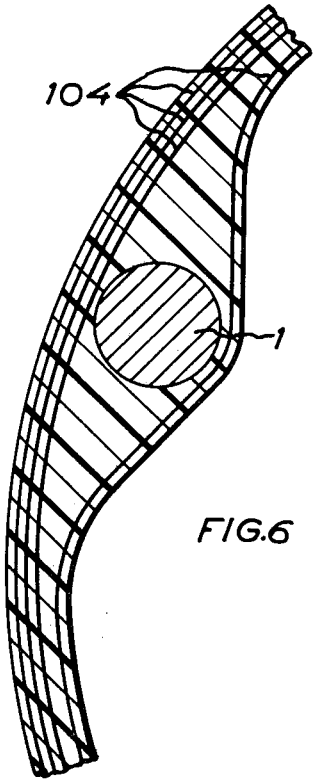
FIG. 6

POSTS

This is a continuation of application Ser. No. 389,319, filed Aug. 17, 1973, and now abandoned.

The present invention refers to a post intended preferably for use in street-lighting systems, traffic direction signs or such like, comprising a shell and a number of cooperating stiffening rods connected thereto.

It is well known that vehicle-collision with a post, such as a lamp post, often gives rise to serious physical injury, sometimes with fatal results. This is because of the pole's strength and resistance to deformation. It has hitherto proved very difficult to manufacture a pole with the requirements that it, on the one hand, possess the necessary strength to carry the load which is prescribed for its function under the regulations in force; and, on the other hand, not possess such great strength that it provides too powerful a resistance when collided into by a vehicle. The object of the present invention is to solve this problem.

The essential characteristic of the post according to the invention is that the rods are so arranged that, together with their connecting shell, they form a static unit capable of taking up normal stresses, but that the internal connection of the rods via the shell is so designed that it breaks at a certain measure of local transverse stress, at which point the static cooperation of the rods ceases and the post gives way.

Several embodiments of the post according to the invention will be described in more detail hereinbelow, with reference to the accompanying drawing, in which:

FIG. 4 is a cross-section of a modified embodiment of the post;

FIG. 5 is a cross-section, on a larger scale, of a section of the wall in a further modified embodiment, and FIG. 6 is a cross-section of a portion of yet another modified embodiment in which the shell consists of plastics material or the like.

Figure 1:
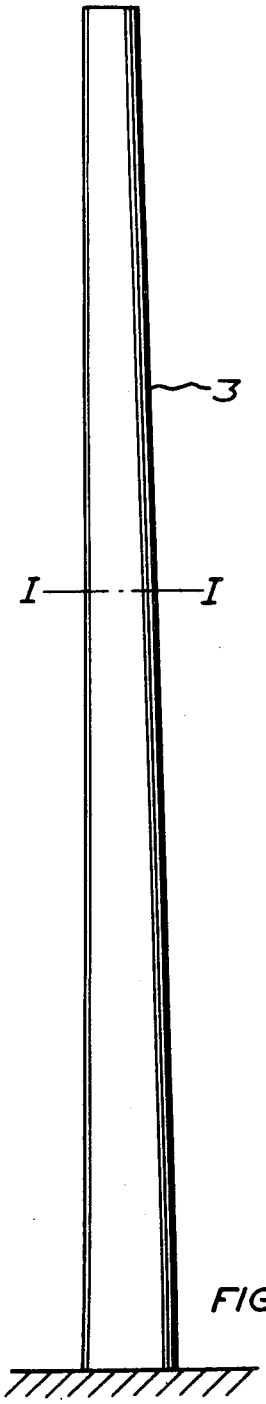
FIG. 1 shows a side elevation of an embodiment of the post.
Figure 2:
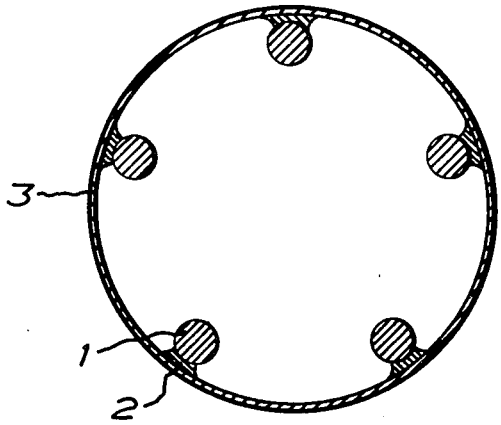
FIG. 2 is a cross-section of the same post along line I—I in FIG. 1.
Figure 3:
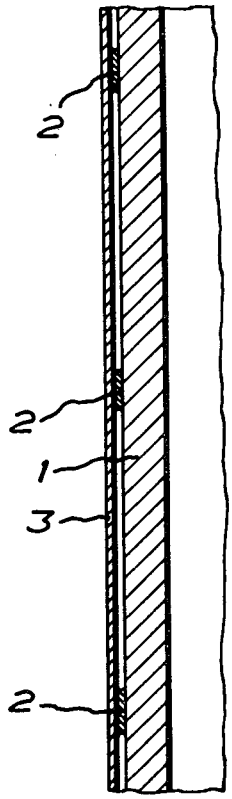
FIG. 3 is a longitudinal section, on a larger scale, of a section of the wall of the post.

The post as shown in FIGS. 1–3 is constructed of a series of rods 1 which are connected by welded joints 2 to a shell 3. The rods can be homogeneous but can also be tubular. In the illustrated embodiment the rods, as well as the shell, consist of steel or a similar material. Instead of welded joints, this embodiment may also employ mechanical connecting means, such as rivets, screws or the like.

The welded joints 2, or other connecting means, are so arranged that they connect the rods into a static unit via the shell. The rigidity of this unit is sufficient to take up the stresses from the lighting device, or such like, attached to the pole, as well as wind stress, in all cases with the necessary margin of safety. However, the joints are so adapted or dimensioned that, when the post is subject to force in a transverse direction, because of, for example, collision with a vehicle, they give way. This results in the breaking of the static cooperation between the rods via the shell, at which the rods, one by one, take up the stress. Consequently, the post, without being the cause of too strong a braking effect on the vehicle in collision, gives way and collapses. When subject to considerable stress, the post can thus be deformed a considerable distance in its longitudinal direction. This does not mean that the post topples;

instead its upper portion can retain substantially perpendicular position, although a lower portion thereof has been flattened and lies along the ground.

In the embodiment shown in FIG. 4 the rods 1 are arranged on the exterior of the shell which is designated 3'.

As in the embodiment shown in FIGS. 1–3, the welded joints between the rods and the shell can be arranged intermittently, i.e. with spacings, but continuous welding along the rods can also be carried out. It is normally, in this latter case, not the welding connections which break, on collision, but instead the material of the shell between the rods which is deformed and fractured. The effects of this are, in principle, the same as is the case with the embodiment comprising the spaced welded joints.

In the embodiment as illustrated in FIG. 5, the shell 103 is of plastics material, having interior beads 102 which surround the rods 1. The shell with the beads can be said to correspond to the shell 3 and the welded joints 2 in the embodiment described above. Thus, the rods 1 are connected by means of the shell and the beads to form a static unit. The beads can have the shape as shown by the solid lines, but another possibility will be to form the beads with indented bases, as is shown by the dash and dot lines.

On collision, the beads are fractured or, alternatively, are torn loose from the shell, whereupon the internal cooperation of the rods is broken.

In the embodiment as shown in FIG. 6, the post shell is manufactured of glass fibre-reinforced plastics material or other reinforced or non-reinforced plastics material. The reinforcement 104 in the shell itself can be multiplied, while lesser reinforcement, or even none at all, has been arranged within the stiffening rods. Thus, on collision, the material inside the rods is designed to be broken, whereupon the static cooperation between the rods ceases and the post gives way.

Obviously, the post according to the invention can be varied within broad limits, as far as the choice of material and dimensions is concerned.

Thus, the invention should not be considered as limited to the embodiment as described and as shown on the drawing, but may be modified in a variety of ways within the scope of the appended claims.

What I claim and desire to secure by Letters Patent is:

1. A yieldable post comprising a closed tubular shell and a plurality of longitudinally extending rods each having a length generally equal to that of the shell, connected to said shell, the shell and rods both having ability to take up tensile as well as compression stresses and to form together a statically cooperating unit, wherein the rods are weld connected to the shell at a plurality of spaced-apart discrete locations along their respective lengths and wherein the connections between the shell and rods being breakable under a predetermined transverse and locally acting vehicle impact load to break the cooperation between shell and rods and to thereby allow yielding of the post with the shell and rods yielding separately in the zone of impact.

2. A yieldable post according to claim 1 wherein the wall thickness of the shell is smaller than the cross sectional dimension of the rods.

3. A yieldable post according to claim 1 wherein said rods are connected to the interior of the shell.

4. A yieldable post according to claim 1 wherein said rods are connected to the exterior of the shell.

* * * * *